US008238796B2

(12) United States Patent
Yoshida et al.

(10) Patent No.: US 8,238,796 B2
(45) Date of Patent: Aug. 7, 2012

(54) TONER SUPPLYING DEVICE AND IMAGE FORMING APPARATUS

(75) Inventors: Satoru Yoshida, Kanagawa (JP); Kunihiro Ohyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 511 days.

(21) Appl. No.: 12/482,673

(22) Filed: Jun. 11, 2009

(65) Prior Publication Data

US 2009/0317140 A1 Dec. 24, 2009

(30) Foreign Application Priority Data

Jun. 20, 2008 (JP) ..... 2008-161358

(51) Int. Cl.
*G03G 15/08* (2006.01)

(52) U.S. Cl. ..... 399/258; 399/27; 399/254

(58) Field of Classification Search ..... 399/27, 399/254, 255, 258, 259, 260, 262
See application file for complete search history.

(56) References Cited

U.S. PATENT DOCUMENTS

| | | | | |
|---|---|---|---|---|
| 5,652,947 | A * | 7/1997 | Izumizaki | 399/258 X |
| 5,943,538 | A * | 8/1999 | Choi | 399/258 |
| 6,298,208 | B1 | 10/2001 | Kawamura et al. | |
| 6,795,660 | B2 * | 9/2004 | Yugeta et al. | 399/27 |
| 6,999,704 | B2 * | 2/2006 | Hayashi et al. | 399/258 |
| 7,076,192 | B2 | 7/2006 | Tsuda et al. | |
| 7,110,707 | B2 * | 9/2006 | Nishitani | 399/258 |
| 7,321,744 | B2 | 1/2008 | Hosokawa et al. | |
| 7,398,038 | B2 | 7/2008 | Tsuda et al. | |
| 7,515,856 | B2 | 4/2009 | Ohyama | |
| 7,539,445 | B2 * | 5/2009 | Sasae et al. | 399/258 |
| 7,848,664 | B2 * | 12/2010 | Suenaga et al. | 399/27 |
| 7,856,196 | B2 * | 12/2010 | Sakamoto et al. | 399/254 |
| 7,873,308 | B2 * | 1/2011 | Saito et al. | 399/254 X |
| 2005/0031381 | A1 | 2/2005 | Arimoto | |
| 2005/0207795 | A1 | 9/2005 | Kubota et al. | |
| 2007/0053723 | A1 * | 3/2007 | Iwata et al. | 399/259 |
| 2007/0154243 | A1 | 7/2007 | Taguchi et al. | |
| 2008/0260432 | A1 | 10/2008 | Ohyama et al. | |
| 2009/0087214 | A1 | 4/2009 | Utsunomiya et al. | |

FOREIGN PATENT DOCUMENTS

| | | |
|---|---|---|
| CN | 1580972 A | 2/2005 |
| CN | 1670635 A | 9/2005 |
| JP | 2002-268353 | 9/2002 |
| JP | 2004-139031 | 5/2004 |

OTHER PUBLICATIONS

Office Action issued Jul. 22, 2011 in Chinese Patent Application No. 200910146222.3 (with English translation).
U.S. Appl. No. 12/614,868, filed Nov. 9, 2009, Yamaguchi, et al.

* cited by examiner

*Primary Examiner* — Sandra Brase
(74) *Attorney, Agent, or Firm* — Oblon, Spivak, McClelland, Maier & Neustadt, L.L.P.

(57) ABSTRACT

A toner supplying device which supplies toners contained in a toner container to a developing device is disclosed. The toner supplying device includes a toner tank which stores the toners discharged from the toner container, a toner carrying section which carries the toners stored in the toner tank, a toner dropping route which causes the toners carried by the toner carrying section to drop into the developing device by toner's own weight, a control unit which controls an amount of the toners to flow into the toner dropping route from the toner carrying section, and a stirring member which stirs the toners staying at a region between the toner tank and the toner carrying section.

18 Claims, 11 Drawing Sheets

TONER SUPPLYING DEVICE AND IMAGE FORMING APPARATUS

BACKGROUND OF THE INVENTION

1. Field of the Invention

The present invention generally relates to a toner supplying device for supplying toners contained in a toner container to a developing device and an image forming apparatus using the toner supplying device.

2. Description of the Related Art

Conventionally, in an image forming apparatus using an electrophotographic system such as a copying machine, a printer, a facsimile machine, and a multifunctional peripheral combining the above functions, a toner supplying device has been known in which toners contained in a toner container are supplied to a developing device at a position separated from the toner container (for example, in Patent Document 1).

In Patent Document 1, a toner container (toner bottle) which contains toners is detachably disposed from an image forming apparatus main body, and a developing device (process cartridge) is at a position separated from the toner container. In addition, a toner supplying device (toner carrying device) is between the toner container and the developing device. The toner supplying device provides a toner tank (sub hopper) which stores toners supplied from the toner container, a toner supplying pipe which supplies the toners contained in the toner tank to the developing device, and so on. The toner supplying pipe carries the toners in an obliquely downward direction and supplies the toners to the developing device. In addition, a carrying coil is inside the toner supplying pipe. That is, the toner supplying pipe carries the toners in the obliquely downward direction by using a toner carrying force of the carrying coil and the toner's own weight. In other words, the toners slide through the toner supplying pipe.

The toner supplying device suitably supplies the toners to the developing device corresponding to an amount of toners consumed in a developing process in the developing device.

In the image forming apparatus, it is not necessary for the toner container to be adjacent to the developing device. Therefore, the device design freedom is high and the image forming apparatus can be small sized.

[Patent Document 1] Japanese Unexamined Patent Publication No. 2004-139031

However, in Patent document 1, in some cases, the amount of toners to be supplied to the developing device is varied.

Since the toners are carried in the obliquely downward direction in the toner supplying pipe, when the supply of the toners to the developing device is stopped, even if the carrying coil is stopped, the toners remaining in the toner supplying pipe drop into the developing device due to the toner's own weight. That is, in many cases, an amount of the toners more than a target amount is supplied to the developing device. In this case, the concentration of the toners in the developer (the ratio of the toners to the developer) becomes greater than a target concentration, the image density of an output image may become high, toners may be scattered, and the background image may be degraded, due to lowering a toner charging amount.

Even if the toner supplying pipe (toner supplying section) is disposed in the horizontal direction, the above problem occurs. That is, when the toners are supplied to the developing device from the opening of the toner supplying pipe by using the toner's own weight after carrying the toners in the horizontal direction, remaining toners near the opening may be dropped by the toner's own weight right after stopping the carrying coil. In particular, when the liquidity of the toners is high, this problem remarkably occurs.

In order to solve the above problem, by assuming that an excessive amount of toners is supplied to the developing device after stopping the carrying coil, it can be considered that the toner carrying force of the carrying coil is determined to be lower than a predetermined value beforehand. However, in this case, while the carrying coil is driven, the amount of toners to be supplied to the developing device may be insufficient, the image density of the output image may be lowered, and a toner particle in the developer may be adhered onto an image carrier or the output image.

In order to solve the above problem, it can be considered to provide a control unit which controls the amount of toners to be dropped into a toner dropping route from the toner supplying pipe without lowering the carrying force of the toners by the carrying coil. However, when the toners clog at an upstream side of the toner supplying pipe, the amount of toners to be supplied to the developing device by the toner supplying pipe may be insufficient. Consequently, the image density of the output image may be lowered, and a toner particle in the developer may be adhered onto an image carrier or the output image.

SUMMARY OF THE INVENTION

In a preferred embodiment of the present invention, there is provided a toner supplying device and an image forming apparatus using the toner supplying device in which the amount of toners to be supplied to a developing device in the image forming apparatus is not varied.

Features and advantages of the present invention are set forth in the description that follows, and in part will become apparent from the description and the accompanying drawings, or may be learned by practice of the invention according to the teachings provided in the description. Features and advantages of the present invention will be realized and attained by a toner supplying device and an image forming apparatus using the toner supplying device particularly pointed out in the specification in such full, clear, concise, and exact terms so as to enable a person having ordinary skill in the art to practice the invention.

To achieve one or more of these and other advantages, according to one aspect of the present invention, there is provided a toner supplying device which supplies toners contained in a toner container to a developing device. The toner supplying device includes a toner tank which stores the toners discharged from the toner container, a toner carrying section which carries the toners stored in the toner tank, a toner dropping route which causes the toners carried by the toner carrying section to drop into the developing device by toner's own weight, a control unit which controls an amount of the toners to flow into the toner dropping route from the toner carrying section, and a stirring member which stirs the toners staying at a region between the toner tank and the toner carrying section.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

Best Mode of Carrying Out the Invention

The best mode of carrying out the present invention is described with reference to the accompanying drawings.

First Embodiment

Referring to FIGS. 1 through 4, a first embodiment of the present invention is described.

First, a structure and operations of an image forming apparatus are described.

Figure 1:
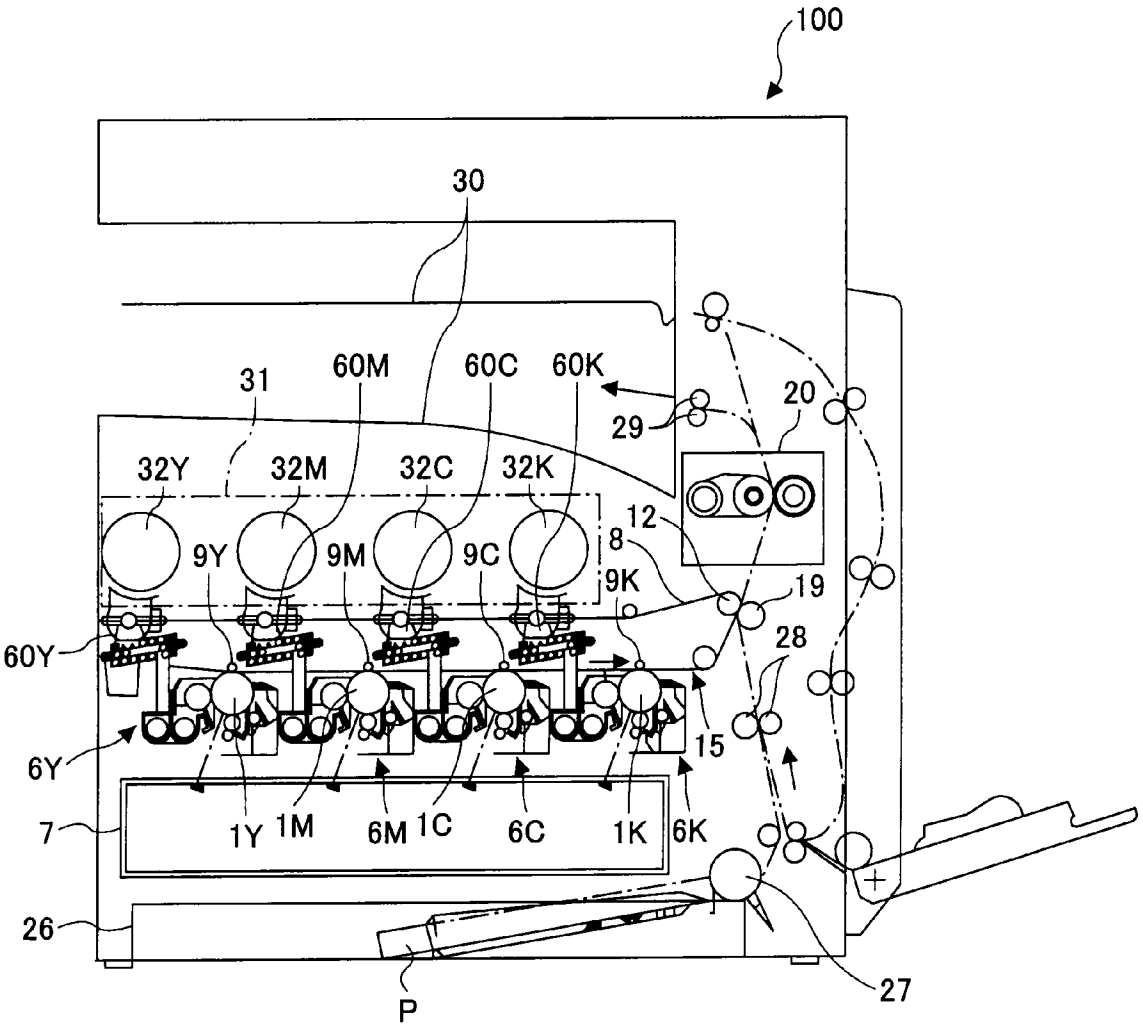
FIG. 1 is a schematic diagram showing a part of a structure of an image forming apparatus main body of an image forming apparatus according to a first embodiment of the present invention.

FIG. 1 is a schematic diagram showing a part of a structure of an image forming apparatus main body 100 of an image forming apparatus according to the first embodiment of the present invention.

As shown in FIG. 1, in a toner container storing section 31 at an upper part of the image forming apparatus main body 100, four toner containers 32Y, 32M, 32C, and 32K corresponding to four colors yellow, magenta, cyan, and black are detachably attached to the toner container storing section 31.

An intermediate transfer unit 15 is provided under the toner container storing section 31. The intermediate transfer unit 15 includes an intermediate transfer belt 8. Image forming sections 6Y, 6M, 6C, and 6K corresponding to the four colors yellow, magenta, cyan, and black are disposed to face the intermediate transfer belt 8.

Toner supplying devices 60Y, 60M, 60C, and 60K are provided under the corresponding toner containers 32Y, 32M, 32C, and 32K. Toners contained in the toner containers 32Y, 32M, 32C, and 32K are supplied to corresponding developing devices in the image forming sections 6Y, 6M, 6C, and 6K by the corresponding toner supplying devices 60Y, 60M, 60C, and 60K.

Some elements in FIG. 1 which are not described above are described below.

Figure 2:
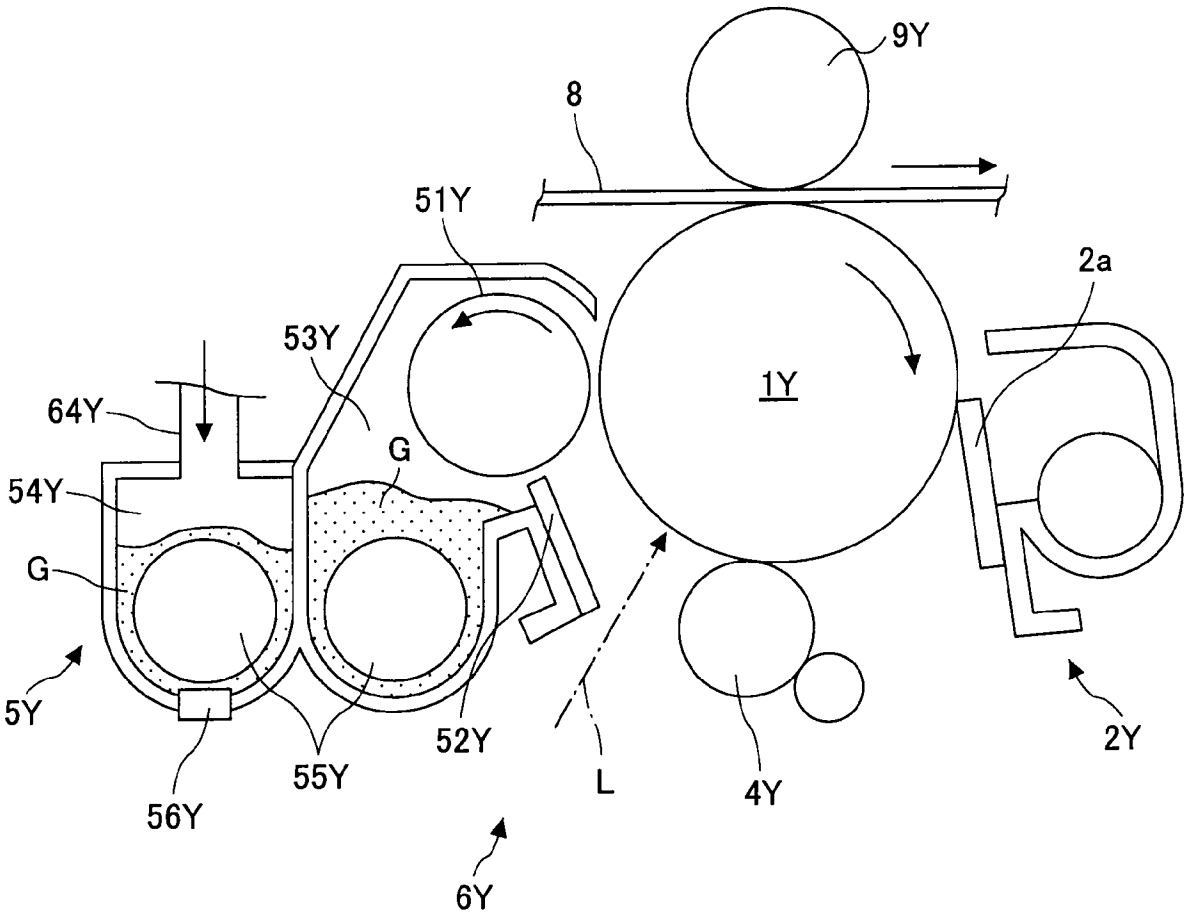
FIG. 2 is a schematic diagram showing a part of the structure of the image forming apparatus main body including an image forming section shown in FIG. 1.

FIG. 2 is a schematic diagram showing a part of a structure of the image forming apparatus main body 100 including the image forming section 6Y shown in FIG. 1.

As shown in FIG. 2, the image forming section 6Y corresponding to the yellow color includes a photoconductor drum 1Y, a charging section 4Y facing the photoconductor drum 1Y, a developing device 5Y (developing section), a cleaning section 2Y, and a discharging section (not shown). Image forming processes (a charging process, an exposing process, a developing process, a transferring process, and a cleaning process) are performed on the photoconductor drum 1Y, and a yellow image is formed on the photoconductor drum 1Y.

Each of the image forming sections 6M, 6C, and 6K has a structure substantially identical to the structure of the image forming section 6Y and forms a corresponding color image. Therefore, in the following, the image forming section 6Y is mainly described while omitting the descriptions of the image forming sections 6M, 6C, and 6K.

In FIG. 2, the photoconductor drum 1Y is rotated clockwise by a driving motor (not shown). Then the surface of the photoconductor drum 1Y is uniformly charged by the charging section 4Y (the charging process).

The surface of the photoconductor drum 1Y reaches a position where laser beams L are radiated from an exposing device 7 (see FIG. 1) and an electrostatic latent image corresponding to yellow is formed at the position by being exposed by the laser beams (the exposing process).

Then the surface of the photoconductor drum 1Y on which the electrostatic latent image has been formed reaches a position facing the developing device 5Y, the electrostatic latent image is developed at the position, and a yellow toner image is formed (the developing process).

Then the surface of the photoconductor drum 1Y on which the toner image has been formed reaches a position facing the intermediate transfer belt 8 and a primary transfer bias roller 9Y, and the toner image on the photoconductor drum 1Y is transferred onto the intermediate transfer belt 8 at the position (a primary transferring process). At this time, a small amount of toners which have not been transferred onto the intermediate transfer belt 8 remain on the photoconductor drum 1Y.

Then the surface of the photoconductor drum 1Y reaches a position facing the cleaning section 2Y and the toners remaining on the surface of the photoconductor drum 1Y are mechanically removed by a cleaning blade 2*a* (the cleaning process).

Finally, the surface of the photoconductor drum 1Y reaches a position facing the discharging section and electric charges remaining on the surface of the photoconductor drum 1Y are discharged.

By the above processes, the image forming process on the photoconductor drum 1Y is completed.

The above image forming process is performed in the image forming sections 6M, 6C, and 6K, similar to in the image forming section 6Y. That is, the laser beams L corresponding to image information are radiated onto the corresponding photoconductor drums 1M, 1C, and 1K from the exposing device 7 disposed under the image forming sections 6M, 6C, and 6K. Specifically, the exposing device 7 causes a light source to emit the laser beams L and radiates the laser beams L onto the corresponding photoconductor drums 1M, 1C, and 1K via plural optical elements while the laser beams L are scanned by a rotating polygon mirror.

After the developing process, the toner images formed on the corresponding photoconductor drums 1Y, 1M, 1C, and 1K are transferred onto the intermediate transfer belt 8 by being superposed. With this, a color image is formed on the intermediate transfer belt 8.

Returning to FIG. 1, the intermediate transfer unit 15 includes the intermediate transfer belt 8, four primary transfer bias rollers 9Y, 9M, 9C, and 9K, a secondary transfer backup roller 12, plural tension rollers (not shown), and an intermediate transfer cleaning section (not shown). The intermediate transfer belt 8 is supported by plural rollers and is endlessly rotated in the arrow direction by the secondary transfer backup roller 12.

Primary transfer nips are formed by sandwiching the intermediate transfer belt 8 between the four primary transfer bias rollers 9Y, 9M, 9C, and 9K and the four photoconductor drums 1Y, 1M, 1C, and 1K. A transfer bias voltage whose polarity is inverted relative to the polarity of the toners is applied to the four primary transfer bias rollers 9Y, 9M, 9C, and 9K.

The intermediate transfer belt 8 sequentially passes through the primary transfer nips of the primary transfer bias rollers 9Y, 9M, 9C, and 9K by being moved in the arrow direction. With this, the toner images on the corresponding photoconductor drums 1Y, 1M, 1C, and 1K are primarily transferred onto the intermediate transfer belt 8 by being superposed.

The intermediate transfer belt 8 onto which the toner images have been transferred by being superposed reaches a position facing a secondary transfer roller 19. A secondary transfer nip is formed at the position where the intermediate transfer belt 8 is sandwiched between the secondary transfer backup roller 12 and the secondary transfer roller 19. Then the four-color toner image formed on the intermediate transfer belt 8 is transferred onto a recording medium P (for example, paper) transported to the position of the secondary nip (a secondary transferring process). At this time, toners which have not been transferred onto the recording medium P remain on the intermediate transfer belt 8.

Then the intermediate transfer belt 8 reaches a position facing the intermediate transfer cleaning section and the toners remaining on the intermediate transfer belt 8 are removed at the position.

With this, the transfer process which is performed on the intermediate transfer belt 8 is completed.

The recording medium P is transported to the position of the secondary nip from a paper feeding section 26 at a lower part of the image forming apparatus main body 100 via a paper feeding roller 27, a pair of registration rollers 28, and so on.

Specifically, the plural recording media P (many pieces of paper) are stored in the paper feeding section 26 by being stacked. When the paper feeding roller 27 is rotated counterclockwise, a top recording medium P is transported to a position between the pair of registration rollers 28.

The recording medium P transported to the pair of registration rollers 28 is temporarily stopped at a roller nip position of the pair of registration rollers 28 whose rotation is stopped. Then the pair of registration rollers 28 is rotated again by matching the timing of the color image on the intermediate transfer belt 8, and the recording medium P is transported to the secondary transfer nip. With this, the color image is transferred onto the recording medium P.

The recording medium P onto which the color image has been transferred at the position of the secondary transfer nip is transported to a fixing section 20 and the color image on the recording medium P is fixed by heat and pressure from a corresponding fixing belt and a pressure applying roller of the fixing section 20.

The recording medium P on which the color image has been formed is output to a stacking section 30 via a pair of paper outputting rollers 29. When plural recording media P are output, the output plural recording media P are sequentially stacked on the stacking section 30.

By the above processes, the image forming process in the image forming apparatus main body 100 is completed.

Next, returning to FIG. 2, a structure and operations of the developing device 5Y in the image forming section 6Y are described in detail.

The developing device 5Y includes a developing roller 51Y facing the photoconductor drum 1Y, a doctor blade 52Y facing the developing roller 51Y, developer containers 53Y and 54Y, carrying screws 55Y in the corresponding developer containers 53Y and 54Y, and a concentration detecting sensor 56Y for detecting a toner concentration in a developer G.

The developing roller 51Y includes a magnet (not shown) secured inside the developing roller 51Y and a sleeve (not shown) which is rotated around the magnet. The developer G (two-component developer) formed of a toner particle and toners is contained in the developer containers 53Y and 54Y. The developer container 54Y is connected to a toner dropping route 64Y via an opening formed at an upper side of the developer container 54Y.

Operations of the developing device 5Y are described.

The sleeve of the developing roller 51Y is rotated in the arrow direction shown in FIG. 2. The developer G carried on the developing roller 51Y by a magnetic field generated by the magnet is moved on the developing roller 51Y while the sleeve is rotated.

The toner concentration of the developer G in the developing device 5Y is adjusted to be a value within a predetermined range. Specifically, toners contained in the toner container 32Y (see FIG. 1) are supplied to the developer container 54Y via the toner supplying device 60Y (see FIG. 1) corresponding to a consumed amount of toners in the developing device 5Y. The toner supplying device 60Y is described below in detail.

The toners supplied to the developer container 54Y are mixed with the developer G in the developer container 54Y, and the developer G is circulated in the two developer containers 53Y and 54Y while the developer G is stirred by the carrying screws 55Y. The developer G is moved in the direction perpendicular to the plane of the paper of FIG. 2.

The toners in the developer G are adhered to a toner particle by a friction charge with the toner particle and are carried on the developing roller 51Y with the toner particle by a magnetic force formed on the developing roller 51Y.

The developer G carried on the developing roller 51Y reaches the doctor blade 52Y by being carried in the arrow direction. The amount of the developer G on the developing roller 51Y is adjusted to be a suitable value by the doctor blade 52Y and the developer G whose amount is adjusted is carried to a position facing the photoconductor drum 1Y. The position is a developing region. The toners in the developer G are adhered onto an electrostatic latent image formed on the photoconductor drum 1Y by an electric field generated in the developing region. The developer G remaining on the developing roller 51Y reaches an upper part in the developer container 53Y by the rotation of the sleeve and the remaining developer G is dropped from the developing roller 51Y.

Figure 3:
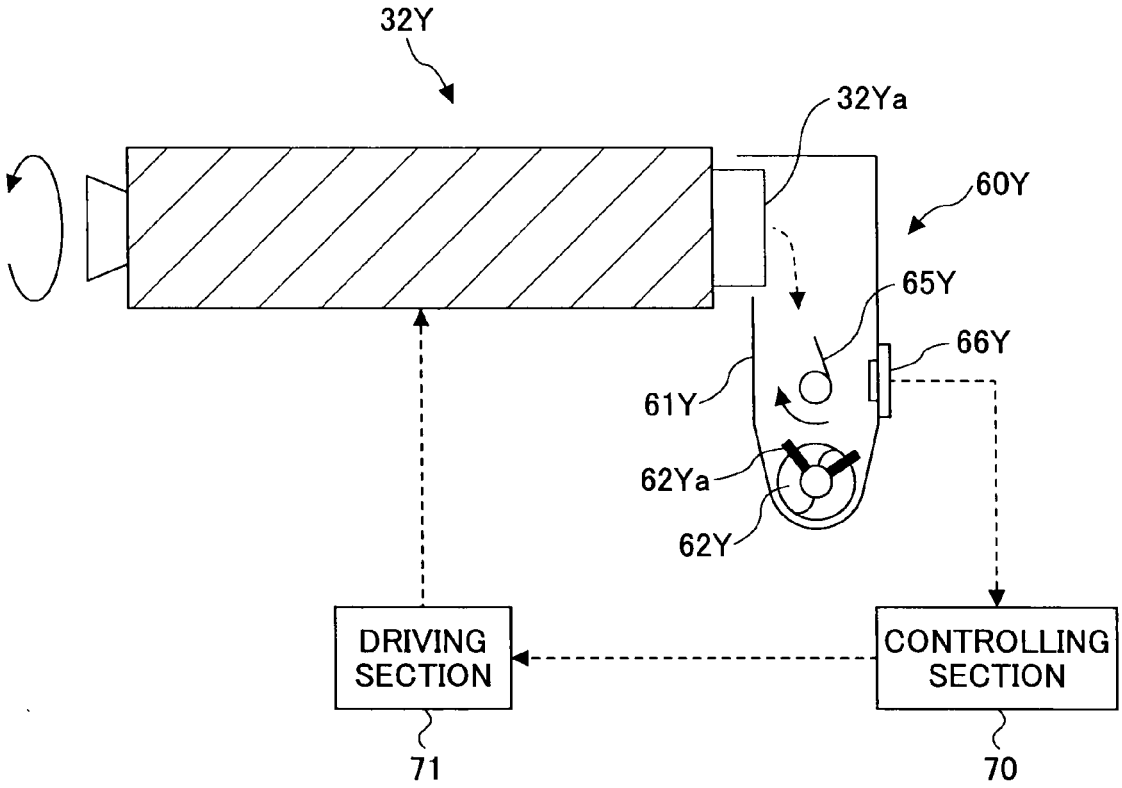
FIG. 3 is a schematic diagram showing a part of the structure of the image forming apparatus main body including a toner container and a toner supplying device shown in FIG. 1.
Figure 4:
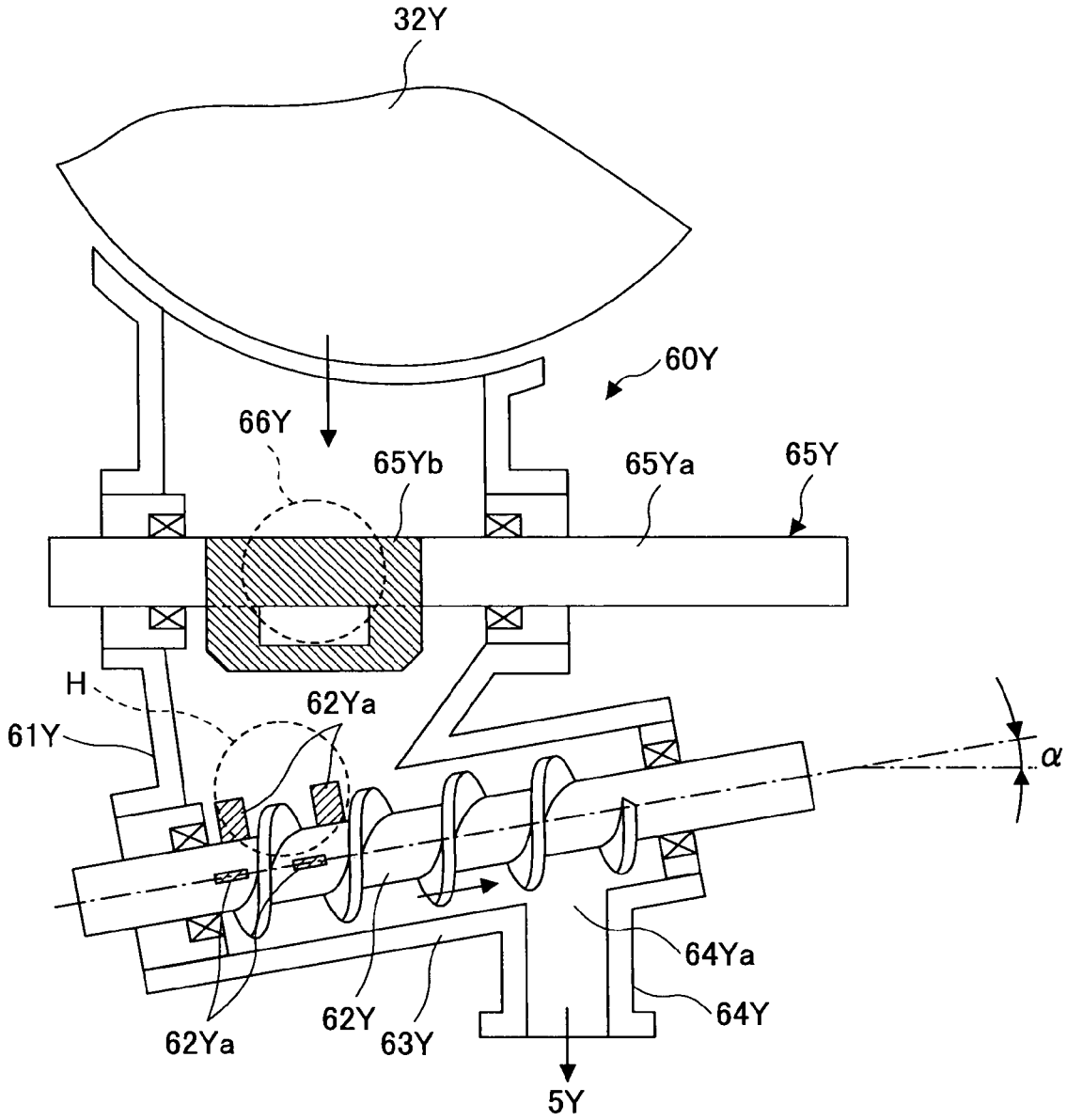
FIG. 4 is a schematic diagram showing a part of the structure of the image forming apparatus main body including the toner supplying device shown in FIG. 1.

Next, referring to FIGS. 3 and 4, the toner supplying device 60Y which supplies toners contained in the toner container 32Y to the developing device 5Y is described.

FIG. 3 is a schematic diagram showing a part of the structure of the image forming apparatus main body 100 including the toner container 32Y and the toner supplying device 60Y shown in FIG. 1. FIG. 4 is a schematic diagram showing a part of the structure of the image forming apparatus main body 100 including the toner supplying device 60Y shown in FIG. 1.

In FIG. 1, the toners contained in the corresponding toner containers 32Y, 32M, 32C, and 32K in the toner container storing section 31 are suitably supplied to the corresponding developing devices by the corresponding toner supplying devices 60Y, 60M, 60C, and 60K based on the consumed amounts of the corresponding toners. The structure of each of the toner supplying devices 60Y, 60M, 60C, and 60K is substantially equal. Therefore, the toner supplying device 60Y is described as the representative.

In FIG. 3, when the toner container 32Y is installed in the toner container storing section 31, a sealing member (not shown) including a cap and a shutter is moved in synchronization with the installation of the toner container 32Y, and a toner outlet 32Ya of the toner container 32Y is opened. With this, the toners contained in the toner container 32Y are discharged from the toner outlet 32Ya and are stored in a toner tank 61Y of the toner supplying device 60Y.

The toner container 32Y is an approximately cylinder-shaped toner bottle, and includes a spiral protrusion on the internal circumferential surface of the toner container 32Y. When the spiral protrusion is viewed from the outside, a spiral groove is viewed. When the toner container 32Y is rotated in the arrow direction by a driving section 71, the spiral protrusion discharges the toners from the toner outlet 32Ya. That is, when the toner container 32Y is suitably rotated by the driving section 71, the toners are suitably supplied to the toner tank 61Y. When the service life of each of the toner containers 32Y, 32M, 32C, and 32K has passed; that is, when almost all toners in the toner container have been consumed, an old one is replaced with a new one.

In FIG. 4, the toner supplying device 60Y includes the toner tank 61Y, a toner carrying screw 62Y, a toner carrying tube 63Y, the toner dropping route 64Y, a toner stirring member 65Y, and a toner end sensor 66Y (detecting unit). The toner carrying screw 62Y and the toner carrying tube 63Y form a toner carrying section.

The toner tank 61Y is under the toner outlet 32Ya (see FIG. 3) of the toner container 32Y and stores the toners discharged from the toner container 32Y. The bottom part of the toner tank 61Y is connected to an upstream side of a toner carrying section (the toner carrying screw 62Y and the toner carrying tube 63Y).

The toner end sensor 66Y is on a wall surface of the toner tank 61Y at a position having a predetermined height from the bottom surface of the toner tank 61Y. The toner end sensor 66Y detects a signal when the amount of the toners stored in the toner tank 61Y becomes a value less than a predetermined value. As the toner end sensor 66Y, a piezoelectric sensor can be used.

In FIG. 3, when the toner end sensor 66Y detects a signal that the amount of the toners stored in the toner tank 61Y has become a value less than a predetermined value, the signal is sent to a controlling section 70. The controlling section 70 controls the driving section 71 to rotate the toner container 32Y for a predetermined period so as to supply toners to the toner tank 61Y. When the toner end sensor 66Y continues to detect the signal even if the driving section 71 repeats rotating the toner tank 32Y, the controlling section 70 determines that no toners remain in the toner container 32Y. Then the controlling section 70 displays a message which instructs to replace the existing toner container 32Y with a new one on a displaying section (not shown) of the image forming apparatus main body 100.

The toner stirring member 65Y (rotating member) is at an inner center position of the toner tank 61Y near the toner end sensor 66Y for preventing the toners stored in the toner tank 61Y from being condensed. In the toner stirring member 65Y, a first flexible member 65Yb formed of, for example, PET (polyethylene terephthalate) is secured to a rotational shaft member 65Ya. The toner stirring member 65Y rotates in the arrow direction clockwise as shown in FIG. 3, and stirs the toners in the toner tank 61Y.

In addition, since the tip of the first flexible member 65Yb of the toner stirring member 65Y slidably contacts the detecting surface of the toner end sensor 66Y with a rotational cycle of the toner stirring member 65Y, lowering the detecting accuracy due to adhering toners onto the detecting surface of the toner end sensor 66Y is prevented. That is, the first flexible member 65Yb functions to clean the detecting surface of the toner end sensor 66Y.

As shown in FIG. 3, since the toner stirring member 65Y (rotating member) is rotated clockwise, tho first flexible member 65Yb slidably contacts the detecting surface of the toner end sensor 66Y disposed at the vertical wall surface of the toner tank 61Y from the upper side to the lower side. Therefore, the remaining toners near the detecting surface cyclically receive an action in which the toners are scraped in the gravitational force direction. Under the above conditions, since the toner end sensor 66Y detects toners on the detecting surface, the detecting accuracy of the toner end sensor 66Y becomes high. One end of the shaft of the toner stirring member 65Y is connected to the driving section 71 and the shaft is rotated by the driving section 71.

In FIG. 4, the toner carrying screw 62Y and the toner carrying tube 63Y carry the toners stored in the toner tank 61Y in the obliquely upward direction (the arrow direction). Specifically, the toner carrying screw 62Y and the toner carrying tube 63Y linearly carry the toners from the bottom part (the lowest part) of the toner tank 61Y to a position above the developing device 5Y (a toner dropping opening 64Ya of the toner dropping route 64Y). The toners reaching at the toner dropping opening 64Ya are supplied to the developer container 54Y (see FIG. 2) of the developing device 5 by the toner's own weight via the toner dropping route 64Y.

The toner carrying screw 62Y in the toner carrying tube 63Y carries the toners by being rotated in a predetermined direction. As described above, the toner carrying screw 62Y and the toner carrying tube 63Y form the toner carrying section.

The toner carrying screw 62Y is a screw member in which a helicoid is spirally formed on a shaft and is rotatably supported in the toner carrying tube 63Y via bearings (not shown). One end of the toner carrying screw 62Y is connected to the driving section 71 (see FIG. 3) and the toner carrying screw 62Y is rotated by the driving section 71. The toner carrying screw 62Y can be formed of a metal material or a resin material.

Flexible members 62Ya (stirring members) which stir toners staying at a region between the toner tank 61Y and the toner carrying tube 63Y are attached to the toner carrying screw 62Y. The flexible member 62Ya is a thin plate type member having a thickness of 0.05 to 0.20 mm formed of, for example, PET.

The length of the flexible member 62Ya is determined to be a length so that the tip of the flexible member 62Ya reaches a region H between the toner tank 61Y and the toner carrying tube 63Y shown in FIG. 4. When the flexible members are rotated by the rotation of the toner carrying screw 62Y, a clogging phenomenon of toners due to staying the toners at the region H (the upstream side of the toner carrying section 62Y and 63Y and the bottom section of the toner tank 61Y) can be prevented. That is, the toners staying at the region H are stirred by the flexible members 62Ya without being condensed.

In other words, a problem can be solved in which the amount of toners to be supplied to the developing device 5Y is insufficient due to a clog of toners at the upstream side of the toner carrying tube 63Y. With this, a problem can be solved in which an image density of an output image is lowered and a toner particle is adhered onto an image carrier and the output image, due to an insufficient amount of toners to be supplied to the developing device 5.

In the above, the flexible members 62Ya are attached to the toner carrying screw 62Y for stirring the toners at the region H. However, without using the flexible members 62Ya, a member rotating a predetermined direction other than the toner carrying screw 62Y can be disposed in the toner supplying device 60, and other flexible members can be attached to the newly disposed member.

The upstream side of the toner carrying tube 63Y is connected to the toner tank 61Y and the downstream side of the toner carrying tube 63Y is connected to the toner dropping route 64Y via the toner dropping opening 64Ya. The toner carrying tube 63Y is a tube-shaped member formed of a resin material. The toner carrying screw 62Y (screw member) is rotatably supported in the toner carrying tube 63Y via a bearing. The gap between the external diameter of the toner carrying screw 62Y and the inner wall of the toner carrying tube 63Y is determined to be approximately 0.1 to 0.2 mm. With this, the toners are smoothly carried in the obliquely upward direction against the gravitational force by the toner carrying screw 62Y and the toner carrying tube 63Y.

As described above, in the first embodiment of the present invention, the toners stored in the toner tank 61Y are carried in the obliquely upward direction by the toner carrying screw 62Y and the toner carrying tube 63Y, and the carried toners are supplied to the developing device 5Y by the toner's own weight via the toner dropping route 64Y. With this, even if the rotation of the toner carrying screw 62Y is stopped when the supply of the toners to the developing device 5Y is stopped, the toners remaining in the toner carrying tube 63Y are hardly dropped into the developing device 5Y via the toner dropping route 64Y. That is, since the toner carrying screw 62Y and the toner carrying tube 63Y carry the toners stored in the toner tank 61Y in the obliquely upward direction, the toner carrying screw 62Y and the toner carrying tube 63Y can operate as a control unit for controlling the amount of toners to flow into the toner dropping route 64Y.

Specifically, the toners remaining at a position separated from the toner dropping opening 64Ya slide toward the toner tank 61Y along the oblique toner carrying tube 63Y or stay at the position. In addition, the toners remaining at a position near the toner dropping opening 64Ya in the toner carrying tube 63Y are not greatly dropped from the toner dropping opening 64Ya by the toner's own weight even if the apparatus is subjected to a great shock, and the toners slide toward the toner tank 61Y along the oblique toner carrying tube 63Y or stay at the position.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, the toners can be prevented from being scattered, and the background image can be prevented from being degraded.

In addition, even if the rotation and non-rotation of the toner carrying screw 62Y are repeated, a large amount of toners remaining in the toner carrying tube 63Y are not supplied to the developing device 5Y. Therefore, the amount of toners remaining in the toner tank 61Y is not greatly varied. Consequently, error detection by the toner end sensor 66Y can be prevented.

In addition, when a cover of the image forming apparatus main body 100 is opened or closed, or the toner container 32Y is attached to or detached from the toner container storing section 31; even if a large vibration caused by the above operations is applied to the toner carrying screw 62Y and the toner carrying tube 63Y, toners remaining in the toner carrying screw 62Y and the toner carrying tube 63Y are hardly dropped into the developing device 5Y via the toner dropping route 64Y.

Further, when toners are immediately supplied into an empty toner carrying screw 62Y and an empty toner carrying tube 63Y from the toner container 32Y at an initial stage, or many images whose image forming area is large are continuously formed (printed); even if the liquidity of toners becomes high, the toners remaining in the toner carrying screw 62Y and the toner carrying tube 63Y are hardly dropped into the developing device 5Y via the toner dropping route 64Y.

In FIG. 4, in order to surely obtain the above effect, it is preferable that the inclination angle $\alpha$ of the toner carrying screw 62Y and the toner carrying tube 63Y relative to the horizontal direction be 5 or more degrees ($\alpha \geqq 5°$). However, when the inclination angle $\alpha$ becomes too large, the toner carrying ability by the toner carrying screw 62Y and the toner carrying tube 63Y is lowered and the height of the apparatus becomes great. Therefore, in the first embodiment of the present invention, the inclination angle $\alpha$ is determined to be approximately 10 degrees.

The inventors of the present invention have performed a first experiment. In the first experiment, two toner supplying devices 60Y were used. In the first toner supplying device 60Y, the inclination angle $\alpha$ is 10 degrees, and in the second toner supplying device 60Y, the inclination angle $\alpha$ is 0 degrees (toners were horizontally carried). Then a toner amount dropped from the toner dropping opening 64Ya to the developing device 5Y was measured right after stopping the toner carrying screw 62Y.

In the results of the first experiment, in the first toner supplying device 60Y ($\alpha$=10°), only 0.0 to 0.2 grams of the toners were dropped into the developing device 5Y via the toner dropping opening 64Ya from 8 grams of the toners remaining in the toner tank 61Y. In the second toner supplying device 60Y ($\alpha$=0°), approximately 2 grams of the toners were dropped into the developing device 5Y via the toner dropping opening 64Ya from 8 grams of the toners remaining in the toner tank 61Y; that is, approximately 25% of the remaining toners was dropped. In addition, in the first toner supplying device 60Y ($\alpha$=10°), since the amount of toners dropped into the developing device 5Y was small, the toner concentration in the developer G in the developing device 5Y was not largely changed. However, in the second toner supplying device 60Y ($\alpha$=0°), since the amount of toners dropped into the developing device 5Y was large, the toner concentration in the developer G in the developing device 5Y became high.

In the experiment, in order to make clear the difference between the two toner supplying devices 60Y, relatively high liquidity toners were used. Specifically, in the toners, a polyester based resin was used as a base resin and the grain diameter of the toners was 6 to 12.5 μm.

As described above, in the first embodiment of the present invention, the flexible members 62Ya for stirring toners staying in the region H between the upstream side of the toner carrying section 62Y and 63Y and the bottom section of the toner tank 61Y are disposed. In addition, the toners stored in the toner tank 61Y are carried in the obliquely upward direction and the carried toners are supplied to the developing device 5Y by the toner's own weight. Therefore, the variation of the amount of the toners to be supplied to the developing device 5Y can be prevented. That is, since the toner carrying screw 62Y and the toner carrying tube 63Y can operate as a control unit for controlling the amount of toners to flow into the toner dropping route 64Y, and the flexible members 62Ya stir the toners at the upstream side of the toner carrying screw 62Y and the toner carrying tube 63Y so that the toners are not clogged; the variation of the amount of the toners to be supplied to the developing device 5Y can be prevented.

Second Embodiment

Next, referring to FIGS. 1, and 5 through 13, a second embodiment of the present invention is described.

In the second embodiment of the present invention, when an element is substantially identical to an element in the first embodiment of the present invention, the same reference number as that in the first embodiment is used for the element. In addition, FIG. 1 is also used in the second embodiment of the present invention.

Figure 5:
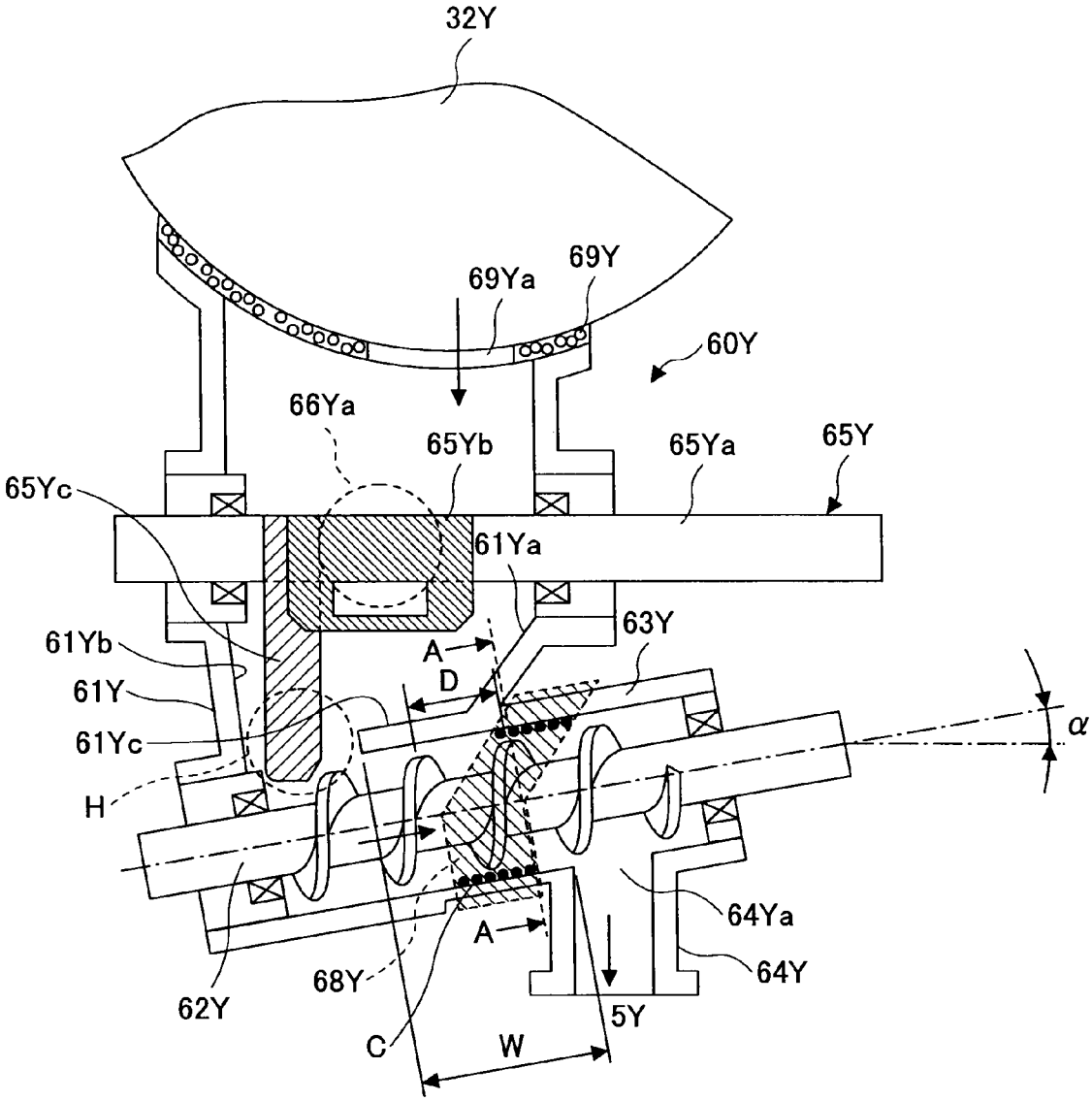
FIG. 5 is a schematic diagram showing a part of a structure of an image forming apparatus main body including a toner supplying device according to a second embodiment of the present invention.
Figure 6:
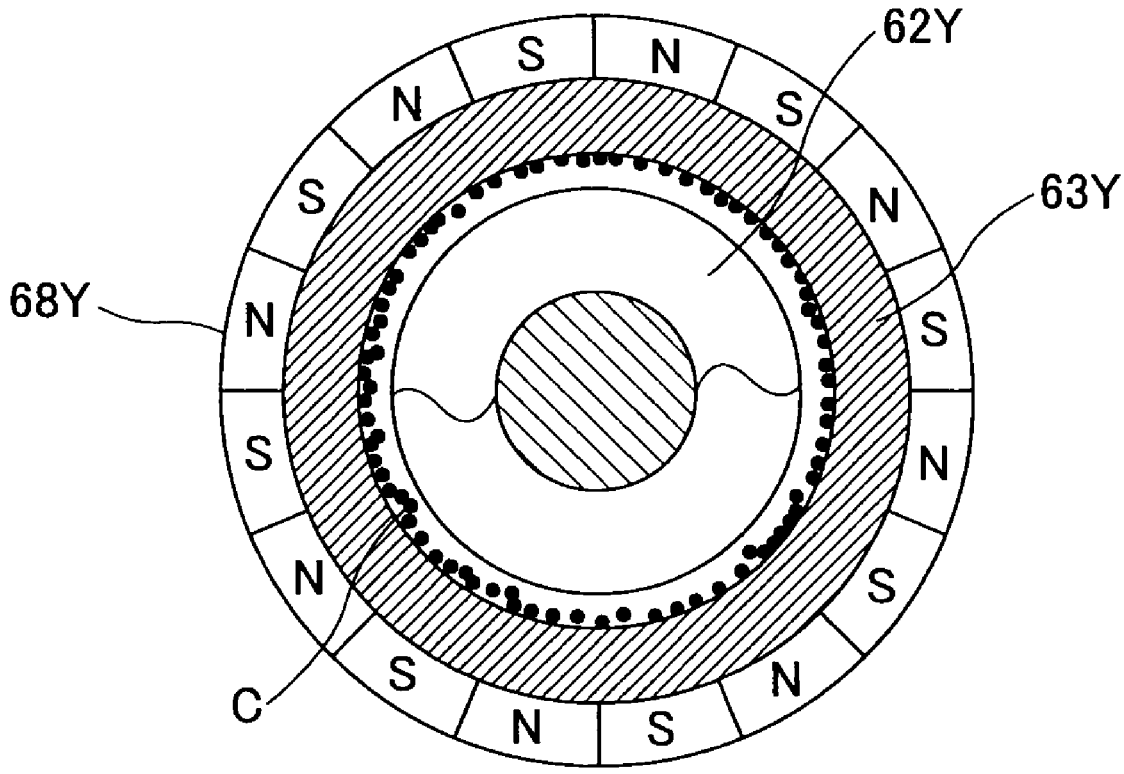
FIG. 6 is a cross-sectional view of the structure shown in FIG. 5 along line A-A of FIG. 5.
Figure 7:
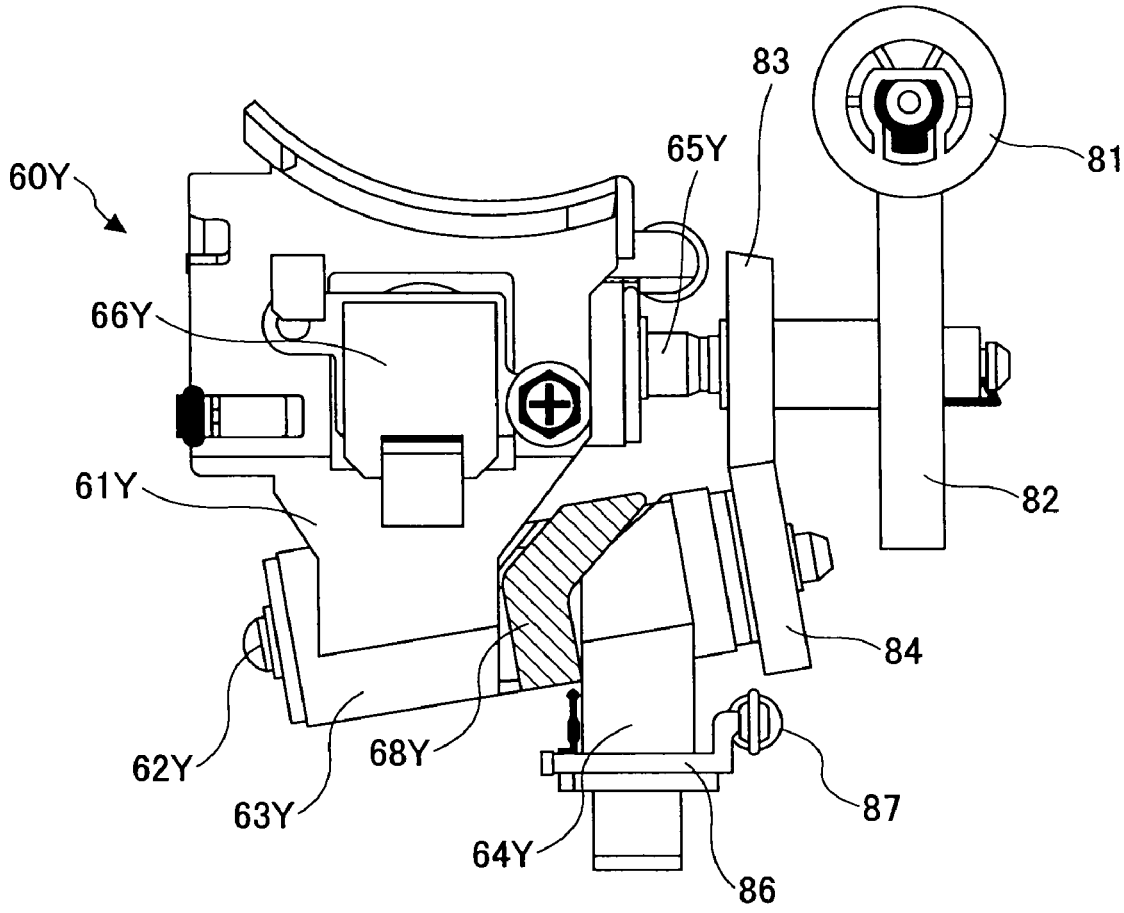
FIG. 7 is an external view of the toner supplying device according to the second embodiment of the present invention.
Figure 8:
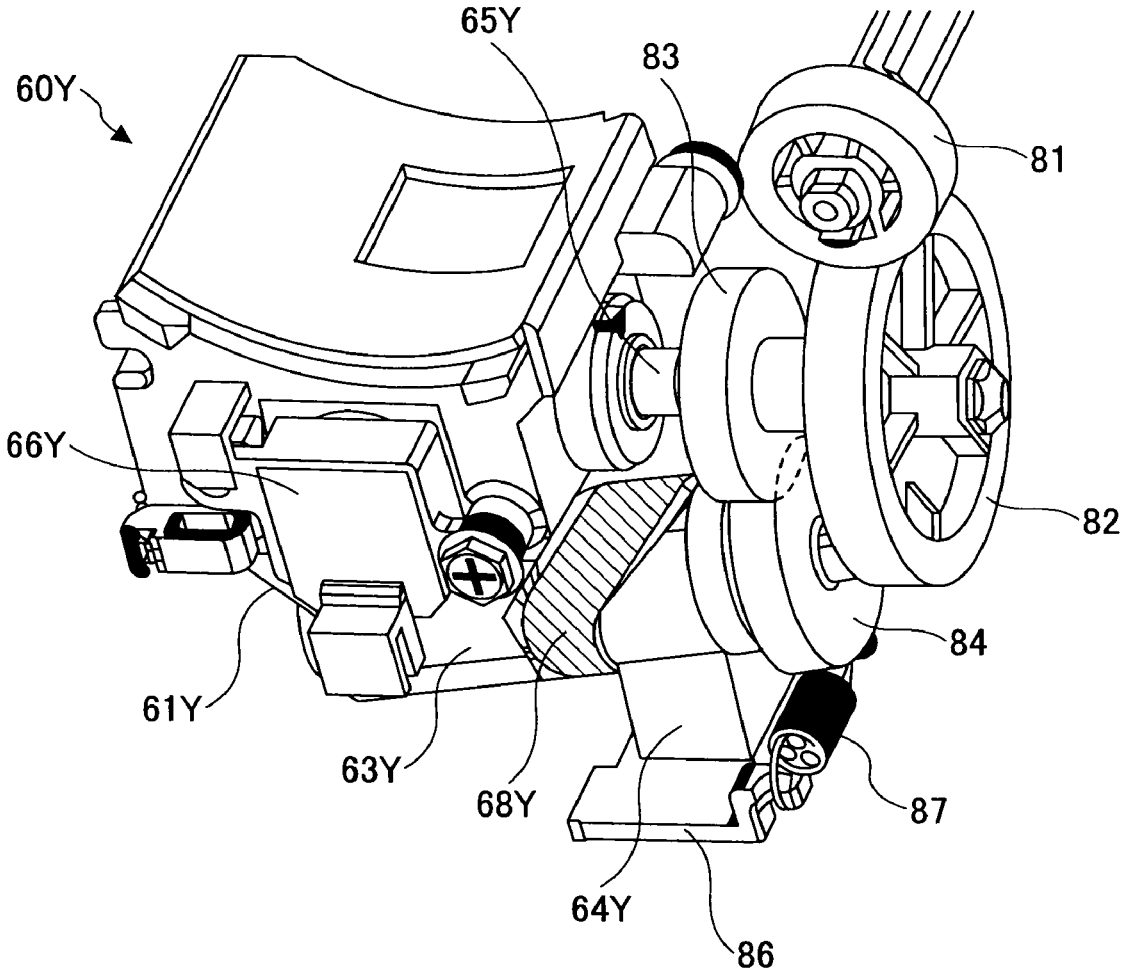
FIG. 8 is a perspective view of the toner supplying device according to the second embodiment of the present invention.
Figure 9:
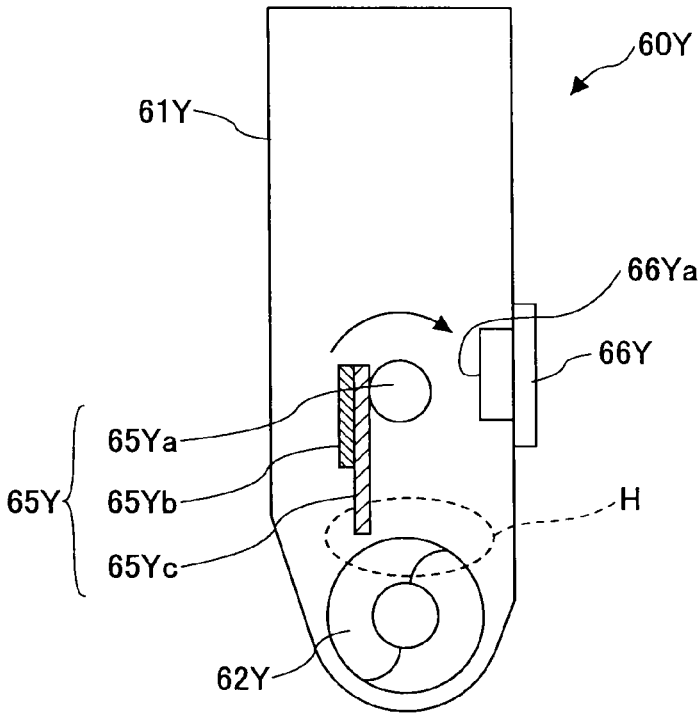
FIG. 9 is a side view of a toner tank in the toner supplying device according to the second embodiment of the present invention.

FIG. 5 is a schematic diagram showing a part of a structure of an image forming apparatus main body 100 including a toner supplying device 60Y according to the second embodiment of the present invention. The drawing of FIG. 5 according to the second embodiment of the present invention corresponds to the drawing of FIG. 4 according to the first embodiment of the present invention. In FIG. 5, a magnetic field generating unit 68Y (permanent magnet) is newly disposed in the toner carrying screw 62Y and the toner carrying tube 63Y. FIG. 6 is a cross-sectional view of the structure shown in FIG. 5 along line A-A of FIG. 5. FIG. 7 is an external view of the toner supplying device 60Y according to the second embodiment of the present invention. FIG. 8 is a perspective view of the toner supplying device 60Y according to the second embodiment of the present invention. FIG. 9 is a side view of the toner tank 61Y in the toner supplying device 60Y according to the second embodiment of the present invention.

The toner supplying device 60Y in the second embodiment of the present invention includes the permanent magnet 68Y which generates a magnetic field for the toner carrying screw 62Y and the toner carrying tube 63Y. In addition, as the toner particle C, a toner particle formed of a magnetic substance is used for carrying toners. Further, a stirring member 65Yc (second flexible member) for stirring toners staying at a region between the toner tank 61Y and the toner carrying section (the toner carrying screw 62Y and the toner carrying tube 63Y) is attached to the toner stirring member 65Y (rotating member).

Other than the permanent magnet 68Y, the external view of FIG. 7 is substantially equal to the external view of the toner supplying device 60Y according to the first embodiment of the present invention. Other than the permanent magnet 68Y, the perspective view of FIG. 8 is substantially equal to the perspective view of the toner supplying device 60Y according to the first embodiment of the present invention.

As shown in FIGS. 5 through 9, similar to the toner supplying device 60Y in the first embodiment of the present invention, the toner supplying device 60Y in the second embodiment of the present invention includes the toner tank 61Y, the toner carrying screw 62Y, the toner carrying tube 63Y, the toner dropping route 64Y, the toner stirring member 65Y, and the toner end sensor 66Y. The toner carrying screw 62Y and the toner carrying tube 63Y form a toner carrying section, carry the toners stored in the toner tank 61Y in the obliquely upward direction, and can operate as a control unit for controlling the amount of toners to flow into the toner dropping route 64Y.

As shown in FIGS. 7 and 8, a bevel gear 82 having a twisting angle of 45 degrees is attached to one end of the shaft of the toner stirring member 65Y, and a driving force is transmitted to the toner stirring member 65Y via a bevel gear 81 having a twisting angle of 45 degrees engaged with the bevel gear 82. In addition, a skew gear 84 is attached to one end of the toner carrying screw 62Y, and a driving force is transmitted to the toner carrying screw 62Y via a skew gear 83 attached to the shaft of the toner stirring member 65Y which skew gear 83 is engaged with the skew gear 84. The above structure is omitted in the first embodiment of the present invention.

In addition, as shown in FIGS. 7 and 8, a shutter 86 is attached to the toner dropping route 64Y, and the shutter 86 is opened or closed when the developing device 5Y is attached to or detached from the image forming apparatus main body 100. Specifically, when the developing device 5Y is attached to the image forming apparatus main body 100, the shutter 86 moves to open the toner dropping route 64Y by being pushed by the developing device 5Y against a force of a spring 87. When the developing device 5Y is detached from the image forming apparatus main body 100, the shutter 86 moves to close the toner dropping route 64Y by the force of the spring 87. With this, when the developing device 5Y is detached from the image forming apparatus main body 100, the toners cannot be scattered in the image forming apparatus main body 100 from the toner dropping route 64Y. The above structure is omitted in the first embodiment of the present invention.

In the second embodiment of the present invention, the control unit, which controls the amount of toners to flow into the toner dropping route 64Y from the toner carrying screw 62Y and the toner carrying tube 63Y, includes the permanent magnet 68Y and the toner particle C of the magnetic substance.

As shown in FIGS. 5 through 8, the permanent magnet 68Y (the magnetic field generating unit) generates a magnetic field in the toner carrying tube 63Y, and is disposed on the external circumferential surface (external wall) of the toner carrying tube 63Y. The permanent magnet 68Y attracts the toner particle C of the magnetic substance to the internal wall of the toner carrying tube 63Y.

When the toner particle C is attracted to the inner wall of the toner carrying tube 63Y by the permanent magnet 68Y on the external wall of the toner carrying tube 63Y, even if the rotation of the toner carrying screw 62Y is stopped when the supply of the toners to the developing device 5Y is stopped, the toners remaining in the toner carrying tube 63Y are likely to stay at the toner particle C. Therefore, a problem can be reduced in which the toners are dropped into the developing device 5Y via the toner dropping route 64Y by the toner's own weight. That is, in addition to the oblique toner carrying screw 62Y and the oblique toner carrying tube 63Y, the permanent magnet 68Y and the toner particle C can operate as the control unit for controlling the amount of toners to be dropped from the toner carrying screw 62Y and the toner carrying tube 63Y into the toner dropping route 64Y right after stopping the operation of the toner supplying device 60Y.

Specifically, the toners remaining at a position separated from the toner dropping opening 64Ya slide toward the toner tank 61Y along the oblique toner carrying tube 63Y or stay at the position of the toner particle C. In addition, the toners remaining at a position near the toner dropping opening 64Ya in the toner carrying tube 63Y are not greatly dropped from the toner dropping opening 64Ya by the toner's own weight even if the apparatus is subjected to a great shock, and the toners slide toward the toner tank 61Y along the oblique toner carrying tube 63Y or stay at the position of the toner particle C.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, toners can be prevented from being scattered and the background image can be prevented from being degraded.

In addition, even if the rotation and non-rotation of the toner carrying screw 62Y are repeated, a large amount of toners remaining in the toner carrying tube 63Y are not supplied to the developing device 5Y. Therefore, the amount of toners remaining in the toner tank 61Y is not greatly varied. Consequently, error detection by the toner end sensor 66Y can be prevented.

In addition, when a cover of the image forming apparatus main body 100 is opened or closed, or the toner container 32Y is attached to or detached from the toner container storing section 31; even if a large vibration caused by the above operations is applied to the toner carrying screw 62Y and the toner carrying tube 63Y, the toners remaining in the toner carrying screw 62Y and the toner carrying tube 63Y are hardly dropped into the developing device 5Y via the toner dropping route 64Y.

Further, when toners are immediately supplied into an empty toner carrying screw 62Y and an empty toner carrying tube 63Y from the toner container 32Y at an initial stage, or many images whose image forming area is large are continuously formed (printed); even if the liquidity of the toners becomes high, the toners remaining in the toner carrying screw 62Y and the toner carrying tube 63Y are hardly dropped into the developing device 5Y via the toner dropping route 64Y.

In particular, in the second embodiment of the present invention, since the toner particle C formed of a magnetic substance is used to carry the toners which toner particle C is supported in the inner wall of the toner carrying tube 63Y, even if the toner particle C is dropped into the developing device 5Y via the toner dropping route 64Y from the toner carrying screw 62Y and the toner carrying tube 63Y, the dropped toner particle C is the same as the toner particle C in the developer G. Therefore, a side effect by the dropped toner particle C hardly occurs in the developing device 5Y. In addition, since the posture of the toner particle C can be flexibly changed in the narrow gap between the toner carrying screw 62Y and the toner carrying tube 63Y, the above effect can be obtained without damaging the toner carrying screw 62Y and the toner carrying tube 63Y by the toner particle C.

The toner particle C is supplied to the toner carrying screw 62Y and the toner carrying tube 63Y when the image forming apparatus main body 100 is delivered to a user.

In addition, in the second embodiment of the present invention, since the permanent magnet 68 is used as the magnetic field generating unit, when the image forming apparatus main body 100 is compared with an image forming apparatus main body using an electromagnet as the magnetic field generating unit, the image forming apparatus main body 100 can be manufactured with a low cost and a small size.

It is preferable that the magnetization direction of the permanent magnet 68Y be only a direction toward the inside of the toner carrying screw 62Y and the toner carrying tube 63Y. Specifically, as shown in FIG. 6, the permanent magnet 68Y is formed of a one-surface multiple-pole magnetization permanent magnet in which S poles and N poles are alternately arrayed circularly by using a publicly-known manufacturing method. With this, abnormal operations caused by an influence of the magnetic field of the permanent magnet 68Y on the outside of the toner carrying screw 62Y and the toner carrying tube 63Y can be prevented. The abnormal operations are, for example, abnormal behavior of the developer G in the developing device 5Y and an error detection by the toner end sensor 66Y.

In FIG. 5, the thickness of the toner carrying tube 63Y where the permanent magnet 68Y is installed is less than the thickness of the toner carrying tube 63Y where the permanent magnet 68Y is not installed. With this, the magnetic force of the permanent magnet 68Y is likely to influence the inside of the toner carrying tube 63Y.

In the second embodiment of the present invention, the magnetic force (magnetic flux density) of the permanent magnet 68Y is determined to be 50 mT (milli-tesla) or more, and the width of the permanent magnet 68Y is determined to be approximately 6 mm in the toner carrying direction.

As shown in FIG. 5, different from the first embodiment of the present invention, in the second embodiment of the present invention, the stirring member 65Yc (second flexible member) for stirring toners staying at the region H between the toner tank 61Y and the toner carrying section (the toner carrying screw 62Y and the toner carrying tube 63Y) is attached to the rotational shaft 65Ya. The stirring member 65Yc is integrated together with the first flexible member 65Yb which cleans a detecting surface 66Ya (see FIG. 9) of the toner end sensor 66Y on the rotational shaft 65Ya (rotational shaft member).

Specifically, as shown in FIGS. 5 and 9, the toner stirring member 65Y (rotating member) includes the rotational shaft 65Ya (rotational shaft member), the first flexible member 65Yb, and the stirring member 65Yc (second flexible member). The stirring member 65Yc is a thin plate type member having a thickness of 0.05 to 0.20 mm formed of, for example, PET.

When the stirring member 65Yc is rotated with the toner stirring member 65Y, a clogging phenomenon of toners due to staying the toners at the region H can be prevented. That is, the toners staying at the region H are stirred by the stirring member 65Yc without being condensed. Therefore, a problem can be solved in which the amount of toners to be supplied to the developing device 5Y is insufficient due to a clog of toners at the upstream side of the toner carrying tube 63Y. With this, a problem can be solved in which an image density of an output image is lowered and a toner particle is adhered onto an image carrier and the output image, due to an insufficient amount of toners to be supplied to the developing device 5.

The stirring member 65Yc is extended into the toner carrying tube 63Y from the inside of the toner tank 61Y. When the length of the stirring member 65Yc is determined to be a sufficiently long length, even if the stirring member 65Yc is curled, the tip of the stirring member 65Yc surely reaches the region H and clogging of the toners in the region H can be prevented.

A part of the first flexible member 65Yb is stacked on a part of the stirring member 65Yc (second flexible member) disposed on the rotational shaft 65Ya. In the rotational shaft 65Ya (the toner stirring member 65Y), the stirring member 65Yc passes through the position of the toner end sensor 66Y after the first flexible member 65Yb has passed through the position of the toner end sensor 66Y by rotating the arrow direction shown in FIG. 9.

Figure 10A:
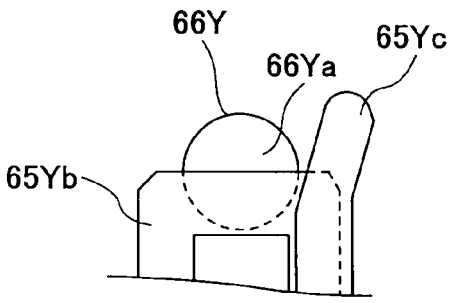
FIG. 10A is a diagram showing a case where a first flexible member contacts a toner end sensor according to the second embodiment of the present invention.
Figure 10B:
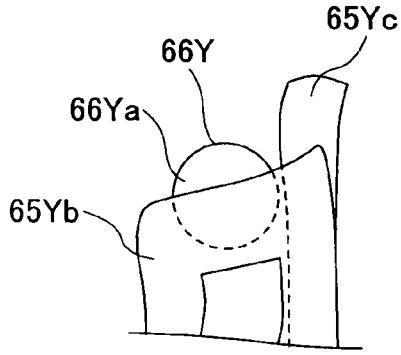
FIG. 10B is a diagram showing another case where the first flexible member contacts the toner end sensor.

FIG. 10A is a diagram showing a case where the first flexible member 65Yb contacts the toner end sensor 66Y when the second flexible member 65Yc (stirring member) and the first flexible member 65Yb are disposed in this order on the rotational shaft 65Ya (see FIG. 9) according the second embodiment of the present invention. FIG. 10B is a diagram showing another case where the first flexible member 65Yb contacts the toner end sensor 66Y when the first flexible member 65Yb and the second flexible member 65Yc (stirring member) are disposed in this order on the rotational shaft 65Ya.

As shown in FIG. 10A, when the rotating member 65Y (see FIG. 9) is rotated, the first flexible member 65Yb reaches the toner end sensor 66Y before the second flexible member 65Yc reaches the toner end sensor 66Y, and the first flexible member 65Yb uniformly contacts the detecting surface 66Ya of the toner end sensor 66Y without being deformed. Therefore, the first flexible member 65Yb can surely clean the detecting surface 66Ya of the toner end sensor 66Y.

However, as shown in FIG. 10B, when the rotating member 65Y (see FIG. 9) is rotated, the second flexible member 65Yc reaches the toner end sensor 66Y before the first flexible member 65Yb reaches the toner end sensor 66Y, and the first flexible member 66Yb non-uniformly contacts the detecting surface 66Ya of the toner end sensor 66Y with being deformed. Therefore, the first flexible member 65Yb cannot surely clean the detecting surface 66Ya of the toner end sensor 66Y. Therefore, in the second embodiment of the present invention, the first flexible member 65Yb is disposed on the second flexible member 65Yc (stirring member) on the rotational shaft 65Ya.

In addition, as shown in FIG. 5, the stirring member 65Yc is disposed at a position where the stirring member 65Yc does not contact the detecting surface 66Ya of the toner end sensor 66Y. With this, the detecting surface 66Ya of the toner end sensor 66Y can be prevented from being worn away and being scratched due to the contact with the stirring member 65Yc.

As shown in FIG. 5, similar to the first embodiment of the present invention (description is omitted in the first embodiment of the present invention), in the second embodiment of the present invention, a right-side wall surface 61Ya of the toner tank 61Y is gently slanted compared with a left-side wall surface 61Yb of the toner tank 61Y. A sponge seal 69Y and a toner input opening 69Ya formed at a part of the sponge seal 69Y are positioned right above the right-side wall surface 61Ya. The sponge seal 69Y fills a gap between the toner container 32Y and the toner tank 61Y by being compressed by the toner container 32Y and the toner tank 61Y.

An external circumferential surface 61Yc having a gently slanted sliding surface of the toner carrying tube 63Y is formed at the left side of the right-side wall surface 61Ya by being connected to the right-side wall surface 61Ya. The toners supplied from the toner container 32Y via the toner input opening 69Ya are loosened by hitting the rotational shaft 65Ya, the first flexible member 65Yb, and the second flexible member 65Yc (stirring member) of the toner stirring member 65Y disposed above the right-side wall surface 61Ya.

Further, the toners slide down the right-side wall surface 61Ya and the external circumferential surface 61Yc while the toners are loosened by hitting the right-side wall surface 61Ya and the external circumferential surface 61Yc, and flow into the toner carrying upstream side of the toner carrying screw 62Y (the slanted left-end side). Moreover, at the region H, the toners are aggressively stirred by the stirring member 65Yc. As described above, in the second embodiment of the present invention, the toner carrying route can be long in a relatively small space, and the plural toner hitting positions can be formed. With this, the toner stirring ability can be increased.

As shown in FIGS. 5, 7, and 8, the upper half part of the permanent magnet 68Y is obliquely wound around the toner carrying tube 63Y. With this, while maintaining the long toner carrying route, the amount of the toner particle C to be supported at a position facing the upper part of the toner carrying screw 62Y can be relatively large (controlling ability of the amount of the toners to flow into the developing device 5Y can be increased). That is, the amount of the toner particle C attracted by the permanent magnet 68Y at the position above the toner dropping route 64Y can be relatively large and the toners to be dropped into the toner dropping route 64Y can be small.

In addition, the lower part of the permanent magnet 68Y is near the toner dropping route 64Y on the external circumferential surface of the toner carrying tube 63Y. With this, the toners remaining in the toner carrying tube 63Y at the position near the toner dropping opening 64Ya are likely to stay at the position without dropping from the toner dropping opening 64Ya by the toner's own weight.

In addition, in the second embodiment of the present invention, as shown in FIG. 5, in the toner carrying tube 63Y, it is determined that a toner carrying route length W from one opening end connecting to the toner tank 61Y to one end of the toner dropping route 64Y is 1.5 times or more a screw pitch D ($W \geqq 1.5 \times D$). The inventors of the present invention have found that the effect of the present invention is surely obtained by the above determination in a second experiment described below shown in FIG. 11.

In the second experiment, two toner supplying devices 60Y were used. In the first toner supplying device 60Y, the permanent magnet 68Y and the toner particle C formed of a magnetic substance were used, and in the second toner supplying device 60Y, the permanent magnet 68Y and the toner particle C formed of a magnetic substance were not used. Then the amount of toners dropped from the toner dropping opening 64Ya to the developing device 5Y was measured when toners having high liquidity were carried by the toner carrying screw 62Y and the toner carrying tube 63Y.

In the second experiment, 235 grams of toners whose base resin is a polyester based resin and whose grain diameter is 6 to 12.5 μm were supplied in the toner container 32Y and the toner container 32Y was shaken a few times up and down to increase the liquidity of the toners. Then the toner container 32Y was attached to the image forming apparatus main body 100.

In the results of the second experiment, in the first toner supplying device 60Y, only 0.0 to 0.5 grams of the toners were dropped into the developing device 5Y via the toner dropping opening 64Ya from 235 grams of the toners in the toner container 32Y. However, in the second toner supplying device 60Y, approximately 10 grams of the toners were dropped into the developing device 5Y via the toner dropping opening 64Ya from 235 grams of the toners in the toner container 32Y. In addition, in the first toner supplying device 60Y, since the amount of the toners dropped into the developing device 5Y was small, the toner concentration in the developer G in the developing device 5Y was not greatly varied. However, in the second toner supplying device 60Y, since the amount of the toners dropped into the developing device 5Y was large, the toner concentration in the developer G in the developing device 5Y was greatly varied.

Further, in the second embodiment of the present invention, the inventors of the present invention have performed a third experiment. In the third experiment, in the toner supplying device 60Y, a relationship between the ratio (W/D) and a period was measured. The ratio (W/D) is a ratio of the toner carrying route length W in the toner carrying tube 63Y to the screw pitch D of the toner carrying screw 62Y. The period is time required for the toners to start to drop from the toner carrying tube 63Y to the toner dropping route 64Y after stopping the toner carrying screw 62Y.

In the third experiment, intermittent operations were repeated in which toners were stopped being supplied for 0.1 seconds after supplying the toners to the developing device 5Y for 0.2 seconds. The period was converted into the number of recording media (sheets) of a solid image of A3 size (297 mm×420 mm) to be printed.

Figure 11:
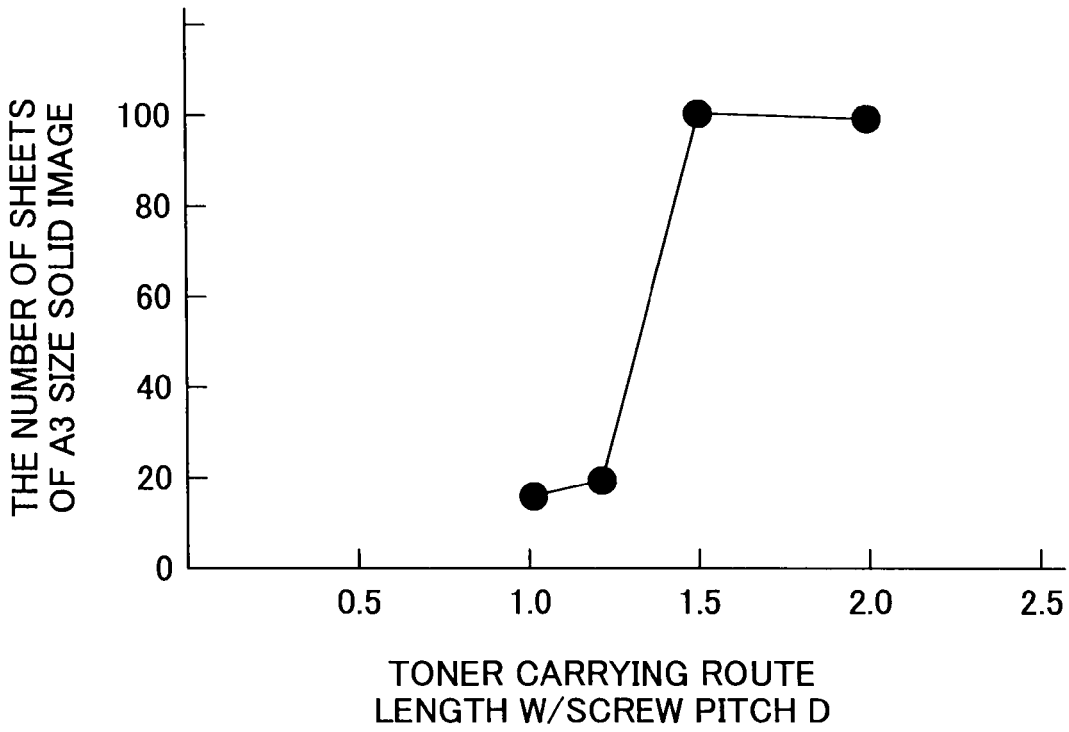
FIG. 11 is a graph showing a result of a second experiment according to the second embodiment of the present invention.

FIG. 11 is a graph showing a result of the second experiment according to the second embodiment of the present invention. In FIG. 9, the horizontal axis shows the ratio (W/D) of the toner carrying route length W in the toner carrying tube 63Y to the screw pitch D of the toner carrying screw 62Y, and the vertical axis shows the number of recording media (sheets) of an solid image of A3 size, and in FIG. 11, the maximum number is determined to be 100 sheets.

As shown in FIG. 11, when the ratio (W/D) becomes 1 or more, the period of time required for the toners to start to drop from the toner carrying tube 63Y to the toner dropping route 64Y after stopping the toner carrying screw 62Y becomes long. When the ratio (W/D) becomes 1.5 or more, the period becomes a sufficiently long constant value. Therefore, it is preferable that the ratio (W/D) be 1.5 or more. That is, when the period is long, the toners are hardly dropped from the toner carrying tube 63Y to the toner dropping route 64Y.

Figure 12:
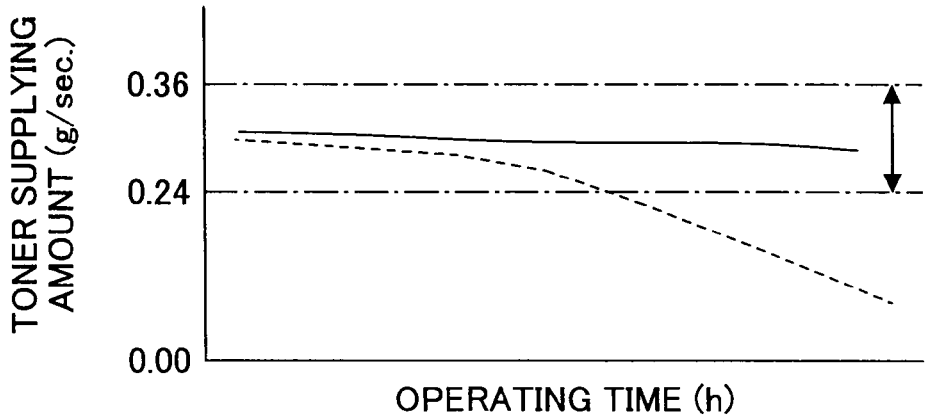
FIG. 12 is a graph showing a relationship between a toner supplying amount to the developing device and operating time of the toner supplying device when the length of the stirring member is changed according to the second embodiment of the present invention.

In addition, in the second embodiment of the present invention, the inventors of the present invention have performed a third experiment. In the third experiment, by using the toner supplying device 60, when the length of the stirring member 65Yc (flexible member) was changed, the change of a toner supplying amount to the developing device 5Y was measured. FIG. 12 is a graph showing a relationship between the toner supplying amount to the developing device 5Y and operating time of the toner supplying device 60 when the length of the stirring member 65Yc is changed.

In FIG. 12, the horizontal axis shows the operating time (hour) of the toner supplying device 60, and the vertical axis shows the toner supplying amount to the developing device 5Y per second. In FIG. 12, the range shown by the arrows is a suitable toner supplying amount (0.24 to 0.36 grams per second). In addition, the continuous line shows a change of the toner supplying amount in which the tip of the stirring member 65Yc reaches inside the toner carrying tube 63Y, and the broken line shows a change of the toner supplying amount in which the tip of the stirring member 65Yc does not reach inside the toner carrying tube 63Y.

From the results of the third experiment, as shown in FIG. 12, the following is understood. That is, when the tip of the stirring member 65Yc does not reach inside the toner carrying tube 63Y, the stirring member 65Yc (second flexible member) is separated from the region H due to a curl of the tip of the stirring member 65Yc with the passage of time, the toner stirring ability is lowered in the region H, and the toner supplying amount is decreased. However, in the second embodiment of the present invention, since the tip of the stirring member 65Yc reaches inside the toner carrying tube 63Y, even if the stirring member 65Yc is curled with the passage of time, the stirring member 65Yc is not separated from the region H, the toner stirring ability is not lowered in the region H, and the toner supplying amount becomes stable.

In addition, in the second embodiment of the present invention, the inventors of the present invention have performed a fourth experiment. In the fourth experiment, in the toner supplying device 60Y, a relationship between a change of the toner supplying amount to the developing device 5Y and a change of a generated amount of condensed toners was obtained when the thickness of the stirring member 65Yc was changed.

Figure 13:
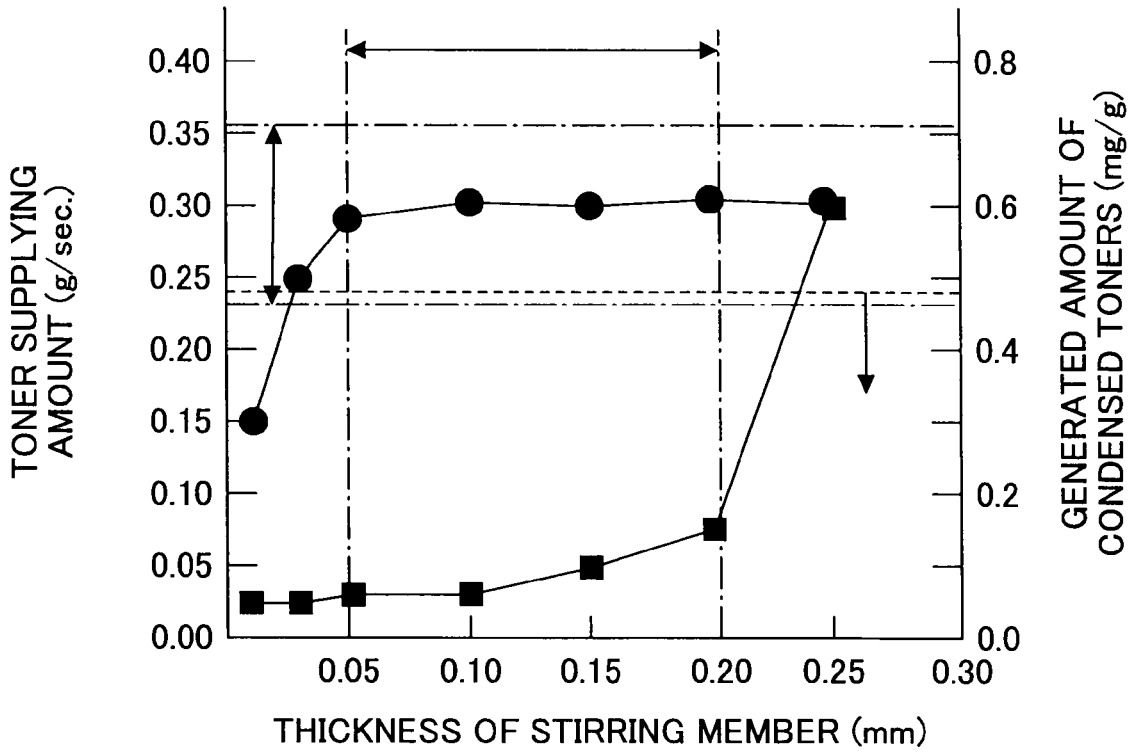
FIG. 13 is a graph showing a relationship between a change of the toner supplying amount to the developing device and a change of a generated amount of condensed toners when the thickness of the stirring member was changed according to the second embodiment of the present invention.

FIG. 13 is a graph showing the relationship between the change of the toner supplying amount to the developing device 5Y and the change of the generated amount of condensed toners when the thickness of the stirring member 65Yc (second flexible member) was changed.

In FIG. 13, the horizontal axis shows the thickness of the stirring member 65Yc (second flexible member), the left side vertical axis shows the toner supplying amount to the developing device 5Y per second, and the right side vertical axis shows the generated amount of condensed toners supplied to the developing device 5Y. In the above, the generated amount of condensed toners is in the developer G of the developing device 5Y.

In FIG. 13, the range shown by the vertical arrows is the suitable toner supplying amount (0.24 to 0.36 grams per second), and the allowable generated amount of the condensed toners is 0.48 mg/g or less. When the generated amount of the condensed toners exceeds the allowable amount, the condensed toners is sandwiched between the developing roller 51Y and the doctor blade 52Y (see FIG. 2), and a white line is formed on an output image in the recording medium transporting direction.

In addition, in FIG. 13, a graph using ● shows the relationship between the thickness of the stirring member 65Yc and the toner supplying amount, and a graph using ■ shows the relationship between the thickness of the stirring member 65Yc and the generated amount of the condensed toners.

From the results of the fourth experiment shown in FIG. 13, when the thickness of the stirring member 65Yc is less than 0.05 mm, the toner stirring ability by the stirring member 65Yc in the region H is lowered, and the toner supplying amount is decreased. When the thickness of the stirring member 65Yc is 0.2 mm or more, the stirring member 65Yc contacts the inner wall of the toner tank 61Y too strongly, and toners sandwiched between the stirring member 65Yc and the inner wall of the toner tank 61Y are likely condensed. From the results of the fourth experiment, in the second embodiment of the present invention, in order to stabilize the toner supplying amount and to prevent the white line image from being formed, the thickness of the stirring member 65Yc (flexible member) is determined to be 0.05 to 0.20 mm (the range shown by the horizontal arrows).

As described above, in the second embodiment of the present invention, the permanent magnet 68Y and the toner particle C control the amount of the toners to be dropped from the toner carrying screw 62Y and the toner carrying tube 63Y to the toner dropping route 64Y, and the stirring member 65Yc (second flexible member) stirs the toners staying in the region H between the toner tank 61Y and the toner carrying section (the toner carrying screw 62Y and the toner carrying tube 63Y). Therefore, the variation of the amount of the toners to be supplied to the developing device 5Y can be prevented.

In the first and second embodiments of the present invention, the toner dropping route 64Y is vertically formed and the toners are dropped by the toner's own weight into the developing device 5Y. However, the toner dropping route 64Y can be formed obliquely to the developing device 5Y and the toners can be dropped by the toner's own weight into the developing device 5Y while the toners are sliding along the oblique surface of the toner dropping route 64Y. That is, in the first and second embodiments of the present invention, the dropping direction of the toners into the developing device 5Y by the toner's own weight includes the direction oblique to the developing device 5Y.

In addition, in the first and second embodiments of the present invention, the toner containers 32Y, 32M, 32C, and 32K only contain the corresponding toners. However, when an image forming apparatus uses a two-component developer, the toner containers 32Y, 32M, 32C, and 32K can contain corresponding two-component developers formed of toners and a toner particle. In this case, the same effects as those in the embodiments of the present invention can be obtained.

In addition, in the first and second embodiments of the present invention, a part or all of the corresponding image forming sections 6Y, 6M, 6C, and 6K can be included in the corresponding process cartridges. In this case, the same effects as those in the first and second embodiments of the present invention can be obtained.

In addition, in FIGS. 4 and 5, the toner carrying route formed of the toner tank 61Y, the toner carrying screw 62Y, the toner carrying tube 63Y, and the toner dropping route 64Y of the toner supplying device 60Y is formed in a И-shaped structure viewed from the direction perpendicular to the plane of the paper of FIGS. 4 and 5. In addition, in FIG. 1, the toner supplying device 60Y is at the left upper position of the image forming section 6Y (process cartridge), and the toner container 32Y is also at the left upper position of the image forming section 6Y. That is, for example, the toner container 32M, a toner tank and the upstream side of a toner carrying section for magenta are not disposed above the image forming section 6M, but above the image forming section 6Y.

With this, in a tandem type image forming apparatus in which plural image forming sections 6Y, 6M, 6C, and 6K are arrayed in parallel, when the image forming section 6Y (process cartridge) is attached to or detached from the image forming apparatus main body 100, the image forming section 6Y and the toner supplying device 60Y do not interfere with each other. Therefore, in the image forming apparatus main body 100, the length in the vertical direction from the toner containers 32Y, 32M, 32C, and 32K to the image forming sections 6Y, 6M, 6C, and 6K can be shortened, and the variation of the amount of toners to be supplied to the corresponding developing devices 5Y, 5M, 5C, and 5K can be prevented.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed embodiments.

The present invention is based on Japanese Priority Patent Application No. 2008-161358, filed on Jun. 20, 2008, with the Japanese Patent Office, the entire contents of which are hereby incorporated herein by reference.

What is claimed is:

1. A toner supplying device which supplies toner contained in a toner container to a developing device, comprising:

a toner tank which stores the toner discharged from the toner container;

a toner carrying section which carries the toner stored in the toner tank;

a toner dropping route which causes the toner carried by the toner carrying section to drop into the developing device by a weight of the toner;

a detecting unit which detects whether an amount of the toner stored in the toner tank becomes a predetermined amount or less;

a control unit which controls an amount of the toner to flow into the toner dropping route from the toner carrying section; and a rotatable shaft having disposed thereon a first flexible member which cleans a detecting surface of the detecting unit by rotating in a predetermined direction; and a second flexible member which is a stirring member which stirs the toner at a region between the toner tank and the toner carrying section, the second flexible member extending into the toner carrying section.

2. The toner supplying device as claimed in claim 1, wherein:

the second flexible member has a thickness of 0.05 to 0.20 mm.

3. The toner supplying device as claimed in claim 1, wherein:

the toner carrying section carries the toner stored in the toner tank in an oblique upward direction; and the control unit includes the toner carrying section.

4. The toner supplying device as claimed in claim 3, wherein:

the toner carrying section linearly carries the toner stored in the toner tank from a bottom section of the toner tank to a position above the developing device.

5. The toner supplying device as claimed in claim 3, wherein:

the toner carrying section is slanted by 5 degrees or more relative to the horizontal direction.

6. The toner supplying device as claimed in claim 1, wherein the control unit includes:

a magnetic field generating unit which generates a magnetic field in the toner carrying section; and a magnetic substance which is supported in the toner carrying section by the generated magnetic field.

7. The toner supplying device as claimed in claim 6, wherein:

the magnetic field generating unit covers a part of an external circumferential surface of the toner carrying section.

8. The toner supplying device as claimed in claim 6, wherein:

the magnetic field generating unit comprises a permanent magnet.

9. The toner supplying device as claimed in claim 6, wherein:

the magnetic substance comprises a toner particle.

10. The toner supplying device as claimed in claim 1, wherein the toner carrying section includes:

a toner carrying screw which carries the toner by rotating in a predetermined direction; and a toner carrying tube having an internal wall in which the toner carrying screw is disposed.

11. The toner supplying device as claimed in claim 10, wherein:

a length of the toner carrying tube from one end of the toner tank to one end of the toner dropping route is 1.5 times a pitch of the toner carrying screw.

12. The toner supplying device as claimed in claim 1, wherein:

the toner container further contains a toner particle in addition to the toner, and supplies the toner and the toner particle to the developing device.

13. The toner supplying device as claimed in claim 1, wherein:

the control unit controls an amount of the toner to drop into the toner dropping route from the toner carrying section right after operations of an apparatus using the toner supplying device is stopped.

14. An image forming apparatus, comprising:

the toner supplying device as clamed in claim 1.

15. The image forming apparatus as claimed in claim 14, wherein:

the developing device is integrated with a process cartridge which is detachably attached to an image forming apparatus main body of the image forming apparatus.

16. The toner supplying device as claimed in claim 1, wherein:

the first flexible member and the second flexible member are integrated with each other.

17. A toner supplying device which supplies toner contained in a toner container to a developing device, comprising:

a toner tank which stores the toner discharged from the toner container;

a toner carrying section which carries the toner stored in the toner tank;

a toner dropping route which causes the toner carried by the toner carrying section to drop into the developing device by a weight of the toner;

a control unit which controls an amount of the toner to flow into the toner dropping route from the toner carrying section; and a stirring member which stirs the toner staying at a region between the toner tank and the toner carrying section, wherein:

the stirring member is a second flexible member which rotates in a predetermined direction, the toner tank includes:

a detecting unit which detects whether an amount of the toner stored in the toner tank becomes a predetermined amount or less; and a first flexible member which cleans a detecting surface of the detecting unit by rotating in a predetermined direction, the second flexible member is formed on a rotational shaft member so as to integrate with the first flexible member, the first flexible member is disposed so as to stack on the second flexible member formed on the rotational shaft member; and the rotational shaft member is rotated so that the second flexible member passes through a position of the detecting unit after the first flexible member passes through the position of the detecting unit.

18. The toner supplying device as claimed in claim 17, wherein:

the second flexible member does not contact the detecting surface of the detecting unit.

* * * * *